US005090587A

United States Patent [19]

Brown

[11] Patent Number: 5,090,587

[45] Date of Patent: Feb. 25, 1992

[54] APPARATUS FOR STORING RECYCLABLE WASTE

[76] Inventor: Randolph K. Brown, 336 Riverside Dr., #4A, New York, N.Y. 10025

[21] Appl. No.: 656,754

[22] Filed: Feb. 19, 1991

[51] Int. Cl.[5] ..... B65D 25/22

[52] U.S. Cl. ..... 220/475; 220/909; 211/71; 211/81; 248/146

[58] Field of Search ..... 211/71, 12, 81; 248/133, 146, 907, 340, 318; 220/23.4, 475, 909; 206/503

[56] References Cited

U.S. PATENT DOCUMENTS

| | | | |
|---|---|---|---|
| 128,551 | 7/1872 | Langdon | 211/81 |
| 1,937,443 | 11/1933 | Shears | 211/81 |
| 1,997,520 | 4/1935 | Heath | 211/81 |
| 2,448,456 | 8/1948 | Niskanen et al. | 248/907 |
| 2,614,700 | 10/1952 | Kjeldsen | 248/907 |
| 3,167,205 | 1/1965 | Smith | 248/133 |
| 3,325,038 | 6/1967 | Ferney | 220/23.4 |
| 3,942,851 | 3/1976 | Kaplan | 248/133 |
| 4,253,561 | 3/1981 | Fontladosa | 248/133 |
| 4,629,074 | 12/1986 | Toder | 211/71 |
| 4,984,704 | 1/1991 | O'Malley | 220/23.4 |

FOREIGN PATENT DOCUMENTS

| | | | |
|---|---|---|---|
| 81559 | 5/1956 | Netherlands | 220/475 |
| 85662 | 6/1955 | Norway | 280/47.18 |
| 334302 | 9/1930 | United Kingdom | 211/71 |
| 732276 | 6/1955 | United Kingdom | 280/47.19 |

*Primary Examiner*—Stephen P. Garbe
*Assistant Examiner*—S. Castellano
*Attorney, Agent, or Firm*—Beehler & Pavitt

[57] ABSTRACT

Apparatus for storing recyclable waste which includes a plurality of waste containers, a rack, and a means to separately mount each of the waste containers on the rack in a manner which provides the user with easy access to each mounted container. Each container can be separately and easily removed from the rack to be placed in a separate location.

14 Claims, 2 Drawing Sheets

APPARATUS FOR STORING RECYCLABLE WASTE

FIELD OF THE INVENTION

This invention relates generally to the storage of recyclable waste and more particularly to apparatus including a plurality of containers and a rack adapted to temporarily store categorized recyclable waste in separate vertically aligned containers.

BACKGROUND OF THE INVENTION

Due to growing environmental concern and the increasingly limited availability of trash disposal facilities, such as land fills and incinerators, it has become apparent that more effort and support must be given to increase the recycling of waste by the general population. Increasing awareness has led to the enactment of laws which require the separation of waste products by individual households prior to being placed for pick-up and delivery to the appropriate recycling facility.

Preparation of recyclable waste for pick-up by the appropriate disposal crew can be divided into two functions. First, the waste must be sorted into different categories of recyclable material. Second, the sorted material must be stored until a disposal crew picks up the waste for transport to the appropriate recycling facility.

The urban apartment dweller is particularly concerned with his limited floor space relative to the area required for storing the sorted waste. If separate freestanding containers are used to sort and store waste, the available floor space in a small house or apartment is thereby reduced. In addition, the sorting operation is complicated when the containers are moved about the apartment and rearranged.

Previous generally unsatisfactory expedients include, for example, the systems described in U.S. Pat. No. 4,893,722 issued to Jones, U.S. Pat. No. 4,941,653 issued to Sterner, Jr., and U.S. Pat. No. 4,682,699 issued to Ertley.

Difficulties with the previous expedients included, for example, the limited number of containers which can be vertically aligned because of the difficulty in accessing the uppermost and lowermost containers.

There is a long-felt, unsolved need for a system of waste preparation and storage which would allow the waste to be easily segregated into recyclable groups, stored in a limited amount of floor space, and easily removed to a curb side or other area for easy pick-up by the appropriate disposal crew.

Such a waste recycling system should be inexpensive, easily accessible, non-obtrusive, take up limited floor space, and provide containers which are freestanding, lightweight, easily moved, and replaceable.

SUMMARY OF THE INVENTION

This invention provides a plurality of inclined containers or compartments for receiving and storing waste. Providing compartments at an inclined angle allows a relatively greater number of compartments to be vertically aligned and thereby this invention does not use as much available floor space.

The waste storage apparatus of the present invention includes a plurality of freestanding storage containers each adapted to receive a predetermined category of trash. Each container is preferably lightweight. Each container is provided with a substantially horizontally disposed opening about its top side relative to its freestanding position for inserting waste therethrouqh.

This invention further includes a support rack adapted to support containers in spaced apart vertical alignment. Each container is adapted to be easily mounted and removed from the support rack.

Preferably a hook, or hooks, is fixed to each container and is configured to engage a horizontally disposed support bar on the support rack. The support rack has a plurality of horizontally disposed support bars in vertical spaced apart alignment. Each support bar is adapted to support at least one container by its hook, or hooks.

The hook, or hooks, are fixed to each container at a point which allows the container to hang in an inclined position, between 1 and 89 degrees from its normal freestanding position depending upon the location of the hook(s), when mounted on to a support bar. Each mounted container is susceptible to slight rotative movement about the support bar upon which it is hooked. The weight of the container, and any waste inserted therein, tends to prevent rotation of the container.

In addition to relying on the positioning of the hook(s) and the weight of the container to keep the container in a stationary inclined position, further means are preferably provided to hold the container in this desired position. These further holding means include spacing the support bars to provide contact between a mounted container and the adjacent support bar immediately below the mounted container. This prevents the natural rotation of the container about the support bar in one direction to the extent that the container contacts the lower adjacent bar.

Additional means are preferably provided for temporarily fixing the container to the lower adjacent bar. These additional means include providing the container with at least one secondary hook which is adapted, and located, to engage the lower adjacent bar.

Preferably the support rack itself is freestanding, and does not require mounting to the floor, wall, or other structure. This allows the storage rack to be moved to any location desired. Additionally the rack is preferably light weight, which also assists in the moving and relocation of the rack. The rack is also preferably inexpensive to manufacture and easy to assemble. One preferred embodiment of the rack provides a pair of parallel and vertically disposed side bars which are attached to different ends of a plurality of horizontally disposed support bars. A foot member is attached to the bottom end of both side members. This foot member is adapted to maintain the side bars in vertical alignment with respect to the surface upon which the support rack rest. The foot structure preferably includes two foot bars each positioned orthogonally with respect to the plane defined by the side bars and support bars.

Each of the individual containers is preferably marked with indicia to provide the user with a means to easily identify the type of waste to be inserted therein.

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

DETAILED DESCRIPTION OF THE PREFERRED EMBODIMENT

Figure 2:
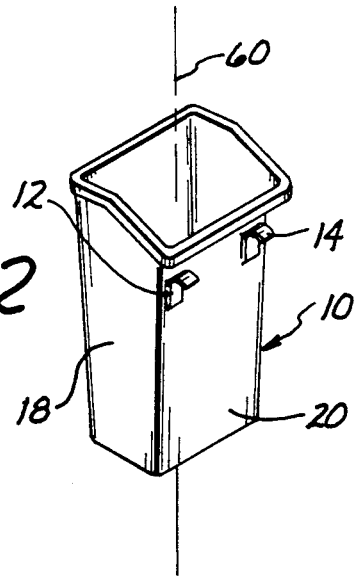
FIG. 2 is a rear perspective view of a preferred embodiment of one container of this invention.
Figure 4:
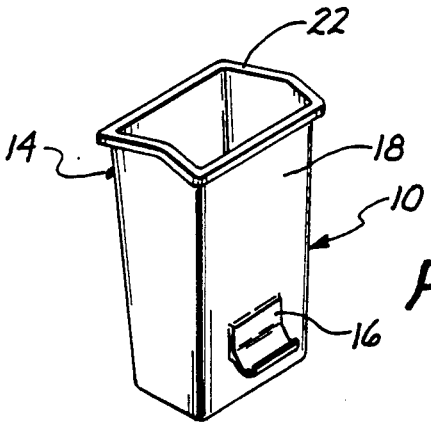
FIG. 4 is a front perspective view of the container shown in FIG. 2.

This invention includes a plurality of containers and a rack. Each container may be configured to resemble one of the many commercially available waste baskets now available. A preferred configuration of container 10, shown in the FIG. 2, includes a front panel 18, a rear panel 20 and a top opening 22. Container 10 is preferably freestanding as shown in FIGS. 2 and 4. Top opening 22 is substantially horizontally disposed, and is preferably slightly slanted from front panel 18 to rear panel 20.

Figure 1:
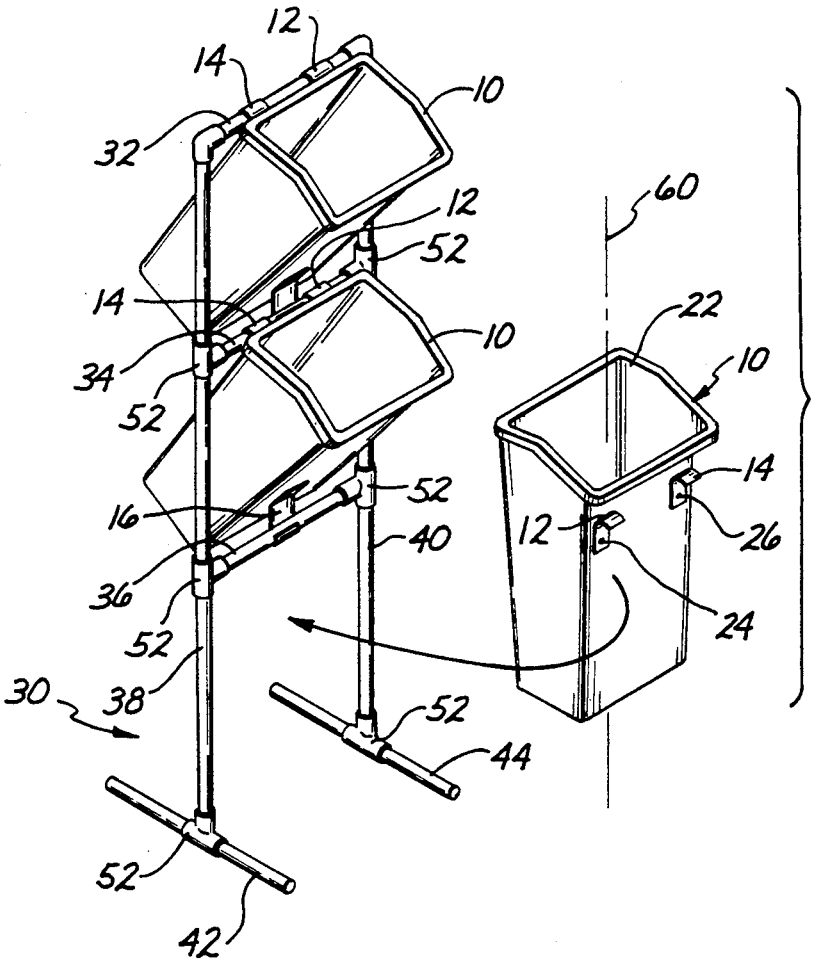
FIG. 1 is a perspective view of the preferred embodiment of this invention.
Figure 3:
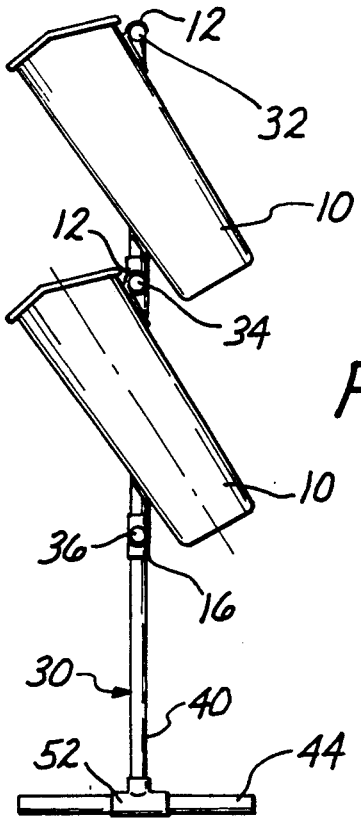
FIG. 3 is a side view of the preferred embodiment of this invention.

Rear panel 20 is provided with at least one hook adapted to be placed on a horizontally disposed support bar. In a preferred embodiment, two hooks 12, 14 are fixed to the upper portion of rear panel 20 at a position which would allow the longitudinal axis 60 of container 10 to hang at an inclined angle when hooked on the horizontally disposed support bar as shown in FIGS. 1 and 3. Hooks 12, 14 are preferably fixed to the rear panel 20 using bolts or screws 24, 26, as shown in FIG. 1. Alternatively, hooks 12, 14 can be integrally formed with rear panel 20 as shown in FIG. 2.

The support rack includes one or more horizontally disposed support bars which are used to support containers 10 in the inclined position shown in FIGS. 1 and 3. Preferably these support bars are vertically aligned as shown in FIGS. 1 and 3 by support bars 32, 34, 36. Support bars 32, 34, 36 could be maintained in vertically alignment by fixing the ends of support bars 32,34, 36 to any of a number fixed structures such as a wall or a ceiling. Preferably, however, support bars, 32, 34, 36 are fixed in vertically alignment as part of an overall support rack 30, which is freestanding. Support rack 30 comprises at least one horizontally disposed support bar, two vertically disposed side bars, a foot assembly, and joining means for fixing the aforementioned elements into an assembly similar to FIG. 1 or FIG. 2.

In FIG. 1, three horizontal support bars 32, 34, 36 are provided. Each support bar 32, 34, 36 is of equal length and is preferably made of a lightweight and rigid material, such as wood, PVC pipe or aluminum, for example. Each end of support bars 32, 34, 36 is fixed to one of side bars 38 or 40. Preferably, L-shaped sleeves are used to connect, and fix, top support bar 32 to the upper portion of side bars 38, 40. T-shaped sleeves are used to connect middle support bar 34 and lower support bar 36 to side bars 38, 40. And T-shaped sleeves 52 are used to connect, and fix, side bars 38, 40 to their respective foot members 42, 44.

Side bars 38 and 40 are preferably made of the same material as support bars 32, 34 and 36. Each side bar 38, 40 is preferably of identical length. The foot assembly is provided to support the parallel side bars 38, 40 in a vertical plane with respect to the surface upon which the support rack stands. The foot assembly preferably consists of two foot members 42, 44 which are aligned parallel to one another and orthogonally with respect to the plane defining the side bars 38, 40 and the support bars 32, 34, 36. Foot members 42, 44 are connected, and fixed, to their respective side bars 38, 40 by insertion into a T-shaped sleeves 52.

A user of this invention hangs one or more containers 10 on rack 30 by positioning the hooks 12, 14 on one of the support bars 32, 34, 36. See FIG. 1. When the container 10 is hooked onto top support bar 32, the weight of container 10 and the positioning of hooks 12 and 14 facilitate the angular presentation of container 10 on rack 30. This angular presentation of container 10 allows the user to have easy access to top opening 22 for inserting waste therein. The angular presentation of container 10 further allows a plurality of containers to be vertically aligned. If the containers were not inclined from their freestanding position on the support rack, then access to any container 10 would be limited by the positioning of another container directly over the top opening 22 of the first container 10. Also, a relatively fewer containers could be vertically stacked. The angular presentation of the containers allows easy access to each container and further provides for a greater number of containers to be vertically aligned and within reach of a user.

The container 10 is easily mounted on or removed from the support rack since the only connection between each container 10 and the support rack 30 is between the hooks 12, 14 and the support bar 32, 34, 36. Container 10 is susceptible to rotative movement about its support bar. Any contact with support rack 30 or a mounted container 10 would result in rotative movement of the container 10 about its support bar. To eliminate such movement, means are provided to eliminate the rotative movement of the container about the support bar by appropriate spacing of the support bars with respect to one another. The height of the container 10 is considered when spacing the support bars on the side bars 38, 40. As shown in FIGS. 1 and 3, the container 10 which is hooked onto top support bar 32 will contact middle support bar 34 if rotated in that direction. Thus, rotative movement of the container 10 supported on top support bar 32 is limited by the position of middle support bar 34. Similarly, the container 10 which is supported on support bar 34 is prevented from rotating to the extent that it contacts lower support bar 36.

Additional means for completely preventing any rotative movement of mounted containers 10 includes temporarily fixing each container to the lower adjacent support bar. A preferred temporary fixing means includes a secondary hook(s) 16 which is permanently fixed to the front panel 18 of each container 10. This secondary hook, or hooks, 16 can be permanently fixed to the container or integrally formed therewith. Hook(s) 16 is adapted to be temporarily secured to the lower adjacent support bar.

Figure 5:
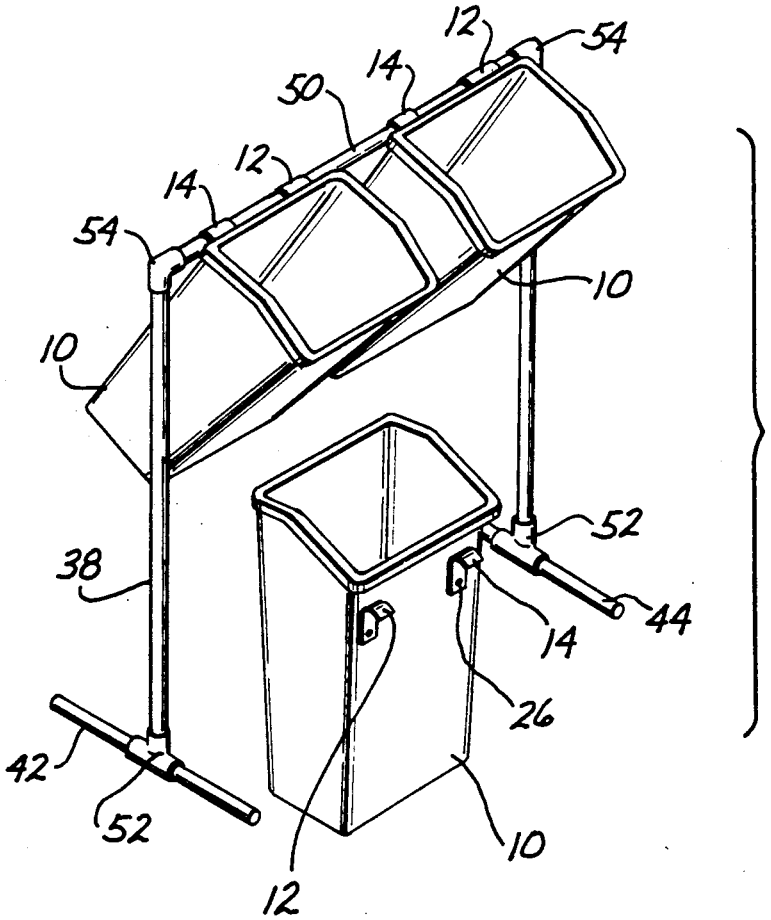
FIG. 5 is a perspective view of an alternative embodiment of this invention.

Additionally, the lowest support bar 36 is preferably positioned at a height sufficient to enable a freestanding container 10 to be positioned beneath the lowest mounted container 10 on support rack 30, as shown in FIGS. 1 and 5.

Three support bars are shown in FIGS. 1 and 3 and each is of sufficient length to support one container 10. However, the support rack 30 can include any number of support bars each having any desired length. One such alternate embodiment is shown in FIG. 5 where the support bar 50 is of sufficient length to allow the mounting thereon of two containers 10. Further, this alternate embodiment shows a support rack with only one support bar 50.

The embodiments shown in FIGS. 1, 3 and 5 disclose portable and freestanding containers which are easily mounted and removed from the portable and freestanding support rack. Alternately, the containers could remain stationary on the support rack and be provided with removable bags or similar compartments.

The foregoing is considered as illustrative only of the principles of the invention. Further, since numerous modifications and changes will occur to those skilled in the art, it is not desired to limit the invention to the exact construction and operation shown and described, and accordingly, all suitable modifications and equivalents may be resorted to, falling within the scope of the invention. What is claimed is as follows:

What is claimed is:

1. Waste storage apparatus comprising:

a plurality of separate generally axially elongated waste containers each of which has a longitudinal axis, an opening at its normally upper end through which to receive presorted waste, and a mounting location, the center of gravity of said waste container being normally axially downward from said opening along said longitudinal axis;

a rack including a plurality of waste container support bars, said waste support bars, being positioned so as to support said plurality of separate waste containers in a normally vertical array within a small vertical space; each of said support bars being non-pivotally interconnected and rigidly fixed with respect to said rack;

mounting means for removably mounting each of said waste containers on a respective one of said waste container support bars, said mounting means being adapted to mount each of said waste containers on said respective support bar at said mounting location, said mounting location being laterally offset from said longitudinal axis and spaced from said center of gravity toward said opening, whereby said longitudinal axis normally defines an acute angle with the perpendicular to the horizon when said waste container is mounted on said rack wherein said mounting means pivotally support said waste containers on said support bars;

at least one hook adapted to be hung on each of said respective one of said support bars; and first fixing means for fixing said at least one hook to a respective one of said waste containers at said mounting location.

2. The waste storage apparatus of claim 1 wherein said support bars are generally arranged in a normally vertical spaced alignment with respect to each other.

3. The waste storage apparatus of claim 1 wherein said rack is freestanding.

4. The waste storage apparatus of claim 1 wherein each of said waste containers is freestanding.

5. The waste storage apparatus of claim 1 wherein said mounting location is laterally offset in the generally vertical direction from said longitudinal axis.

6. The waste storage apparatus of claim 1 wherein said first fixing means comprise said at least one hook being integrally formed with said waste container.

7. The waste storage apparatus of claim 1 further comprising first stop means for preventing the longitudinal axis of said waste containers from assuming a vertical position.

8. The waste storage apparatus of claim 7 wherein said first stop means include each of said waste containers having a length which is greater than the distance between adjacent support bars, whereby the rotation caused by the weight of said waste container and its contents of each of said pivotally mounted waste containers about its respective support bar is prevented to the extent that said waste container contacts a lower adjacent support bar.

9. The waste storage apparatus of claim 1, further comprising second stop means for preventing the longitudinal axis of said waste containers from assuming a horizontal position.

10. Waste storage apparatus comprising:

a plurality of separate generally axially elongated waste containers each of which has a longitudinal axis, an opening at its normally upper end through which to receive presorted waste, and a mounting location, the center of gravity of said waste container being normally axially downward from said opening along said longitudinal axis;

a rack including a plurality of waste container support members, said waste support members being positioned so as to support said plurality of separate waste containers in a normally vertical array within a small vertical space; and mounting means for removably mounting each of said waste containers on a respective one of said waste container support members, said mounting means being adapted to mount each of said waste containers on said respective support member at said mounting location, said mounting location being laterally offset from said longitudinal axis and spaced from said center of gravity toward said opening, whereby said longitudinal axis normally defines an acute angle with the perpendicular to the horizon when said waste container is mounted on said rack, wherein said mounting means pivotally support said waste containers on said support members; and, second stop means for preventing the longitudinal axis of said waste containers from assuming a horizontal position, said second stop means including a connecting member adapted to temporarily connect to one of said waste container support members; and, second fixing means for fixing said connecting member to a respective one of said waste containers at a second location on said container adapted to allow said connecting member to be connected to the lower adjacent one of said waste container support members, whereby said waste container is temporarily fixed to said lower adjacent one of said waste container support members.

11. The waste storage apparatus of claim 10 wherein said second fixing means comprise said connecting member being integrally formed with said waste container.

12. The waste storage apparatus of claim 1 wherein said rack comprises:

a pair of parallel and vertically disposed side bar members, each of said side bar members fixed to a different end of said support bars, said support bars extending perpendicularly form said side bar members; and, a foot member attached to the bottom end of both side bar members, said foot member adapted to maintain said side bar members in vertical alignment with respect to the surface upon which said rack stands.

13. The waste storage apparatus of claim 12 wherein said foot member comprises at least two foot bars each positioned orthogonally with respect to the plane defined by said side bar members and said support bars.

14. The waste recycling storage apparatus of claim 1 wherein each of said waste containers contain indicia designating a predetermined category of trash.

* * * * *